US005223100A

United States Patent [19]

Schiel et al.

[11] Patent Number: 5,223,100

[45] Date of Patent: Jun. 29, 1993

[54] PRESS SHOE FOR EXTENDED NIP PRESS FOR DEWATERING A FIBER WEB

[75] Inventors: Christian Schiel; Andreas Schütte; Thomas Züfle, all of Heidenheim, Fed. Rep. of Germany

[73] Assignee: J. M. Voith GmbH, Fed. Rep. of Germany

[21] Appl. No.: 869,762

[22] Filed: Apr. 16, 1992

[30] Foreign Application Priority Data

Apr. 26, 1991 [DE] Fed. Rep. of Germany ..... 4113623

[51] Int. Cl.[5] ..... D21F 3/02

[52] U.S. Cl. ..... 162/358.3; 100/153; 162/361

[58] Field of Search ..... 162/358, 205, 361, 358.3; 100/118, 153

[56] References Cited

U.S. PATENT DOCUMENTS

| | | | |
|---|---|---|---|
| 4,272,317 | 6/1981 | Roerig | 162/358 |
| 4,287,021 | 9/1981 | Justus et al. | 162/358 |
| 4,643,802 | 2/1987 | Schiel et al. | 162/361 |
| 4,713,147 | 12/1987 | Saarinen | 162/358 |
| 4,861,434 | 8/1989 | Bonander et al. | 162/358 |
| 4,917,768 | 4/1990 | Ilmarinen | 162/358 |
| 4,931,142 | 6/1990 | Steiner et al. | 162/361 |

FOREIGN PATENT DOCUMENTS

| | | | |
|---|---|---|---|
| 3030233 | 2/1982 | Fed. Rep. of Germany | 162/358 |

*Primary Examiner*—Karen M. Hastings

*Attorney, Agent, or Firm*—Ostrolenk, Faber, Gerb & Soffen

[57] ABSTRACT

An extended nip press for the dewatering of a fiber web has an endless flexible press element, like a press jacket or press belt. A press shoe has a concave slide surface for the flexible press element, and the slide surface is adapted to the curve of a backing roll. The shoe is displaceable toward the backing roll in order to press the pressing element against it. A stationary shoe bed, which is detachably connected to a stationary support, has a depression which is provided with a packing and receives the press shoe to form a pressure chamber so that the shoe bed and the press shoe form a cylinder-piston unit. The press shoe is coupled to the shoe bed by means of at least one connecting element. The connecting element is spring biased with respect to the shoe bed and may itself be flexible or be flexibly moved to permit the radial displacement as well as the tilting of the press shoe relative to the shoe bed.

29 Claims, 2 Drawing Sheets

PRESS SHOE FOR EXTENDED NIP PRESS FOR DEWATERING A FIBER WEB

BACKGROUND OF THE INVENTION

The present invention relates to an extended nip press, particularly for dewatering a fiber web. Such a press is usually part of a paper manufacturing machine. The invention specifically refers to an extended nip press having features which are known from U.S. Pat. Nos. 4,272,317, 4,861,434 or 4,931,142.

One essential part of such an extended nip press is an endless, flexible press element, which may be in the form of a tubular press jacket that travels along a substantially circular path outside the pressing zone. The flexible press element can also be developed as a press belt which travels over guide rollers located outside of the press zone.

In both cases, one surface of the flexible press element is applied against a backing roll by a press shoe which acts against the opposite surface of the press element. The press shoe rides on a cushion of liquid in a depression which defines a pressure chamber within a press shoe bed which is part of a stationary support member.

In certain known extended nip presses, the shoe bed, which has the depression that receives the press shoe, is an integral part of the support for the press. Sealing strip supports are arranged at the peripheral edges of the depression in the support member, as shown in U.S. Pat. No. 4,931,142. In another embodiment, shown in U.S. Pat. No. 4,861,434, a structural part, which is separate from the support member, is provided as the shoe bed. The latter patent gives no further information concerning this arrangement.

SUMMARY OF THE INVENTION

It is an object of the present invention to improve a known extended nip press so that both the press shoe and the shoe bed can be made simpler and at less expense than previously. Furthermore, those elements are to be assembled independently of the support of the press. They can therefore also be tested as to their operation, for instance, a test of the seal between the bed and the shoe can be performed under pressure independently of the support.

The invention proceeds from U.S. Pat. No. 4,861,404. Therefore, the shoe bed is not formed of several parts, as in U.S. Pat. No. 4,931,142, namely of the support member and the sealing strip supports. Instead, the shoe bed is developed as a single piece structural part into which the sealing strips are directly inserted. A further advantage can be obtained by detachably connecting the shoe bed to the support member. Then the press shoe is coupled to the shoe bed by at least one connecting element which is so placed and is of a type such that, as previously, the press shoe remains both radially displaceable relative to the shoe bed and the backing roll and tiltable relative to the shoe bed. The combination of these measures enables the shoe bed and the press shoe, together with the sealing strips and the at least one connecting element, to be assembled independently of the support for the press. Furthermore, the connecting element prevents the press shoe from unintentionally escaping from the shoe bed, for instance, under pressure prevailing in the pressure chamber or under the force of gravity. In a previous embodiment according to U.S. Pat. No. 4,931,142, projections were provided for this purpose on the foot of the press shoe. These projections may be absent here. The construction of the invention enables testing of the pre-assembled structural group, comprised of the shoe bed and the press shoe, independently of the press support, and particularly permits testing as to its tightness. In contrast to what was previously the case, this makes it possible to overhaul the extended nip press in an existing paper manufacturing machine by simply replacing the above noted structural group without having to remove the entire extended nip press unit and install it again. It is merely necessary to detach the previously installed shoe bed together with the press shoe from the support member and to replace it by another shoe bed with a press shoe. This replacement may be necessary in order to replace the press shoe with another press shoe if, for instance, the shape of the slide surface of the shoe is to be changed in order to adapt the pressure curve in the press zone in the direction of travel of the web to changed requirements. At times, it may also be necessary to overhaul the sealing strips, should their tight seal have failed and if the desired pressure desired in the pressure chamber can no longer be established.

Other features and advantages of the present invention will become apparent from the following description of the invention which refers to the accompanying drawings.

DETAILED DESCRIPTION OF THE INVENTION

Figure 1:
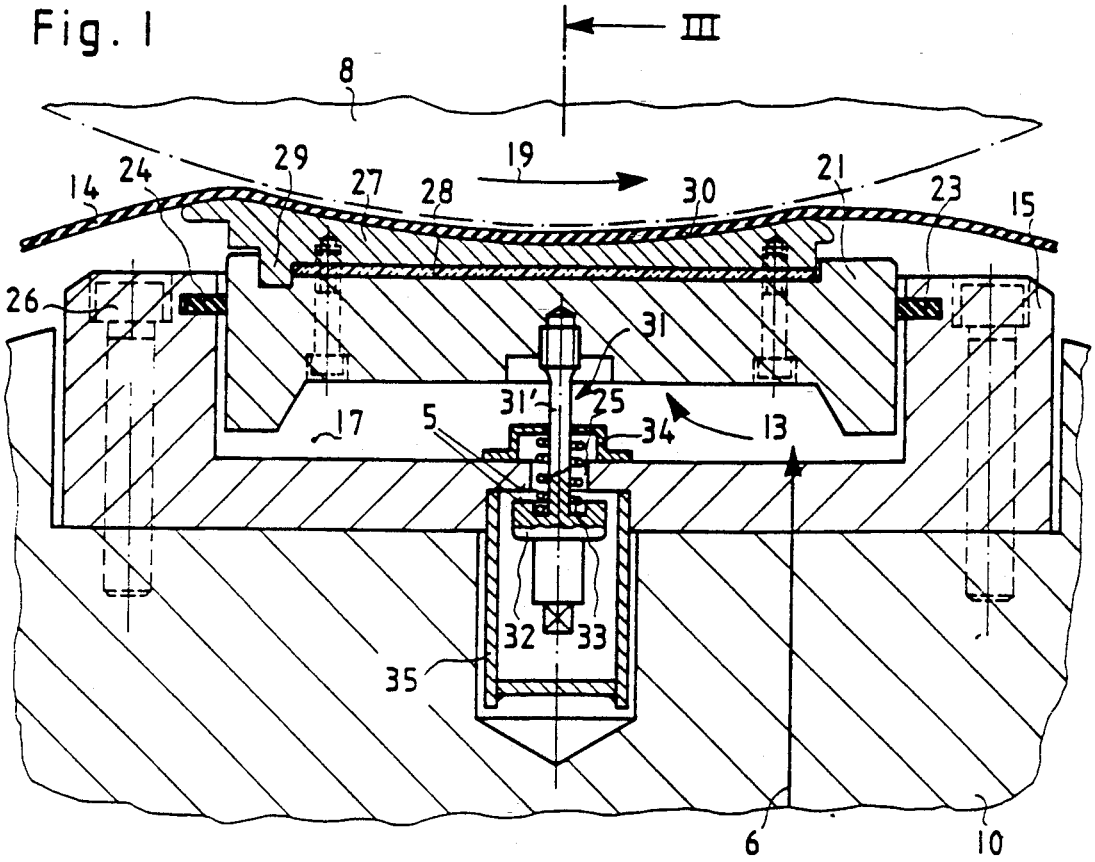
FIG. 1 is a partial cross section through an extended nip press with the direction of applied hydraulic pressure on the press shoe being from bottom to top.

All of the drawing FIGS. show parts of an extended nip press, including a stationary press support 10, a shoe bed 15, and a press shoe 13 present in the bed 15. The press shoe has a concave slide surface 30 which is generally adapted to the curvature of a backing roll 8 which rotates past the shoe. A flexible press element slides over the slide surface of the shoe. The press element is preferably developed as a tubular press jacket 14.

The support 10, shoe bed 15, press shoe 13 and press jacket 14 extend transversely to the direction of travel of the web and transversely over the entire width of the machine. The web, the press jacket and the backing roll all move in the direction of arrow 19.

Figure 3:
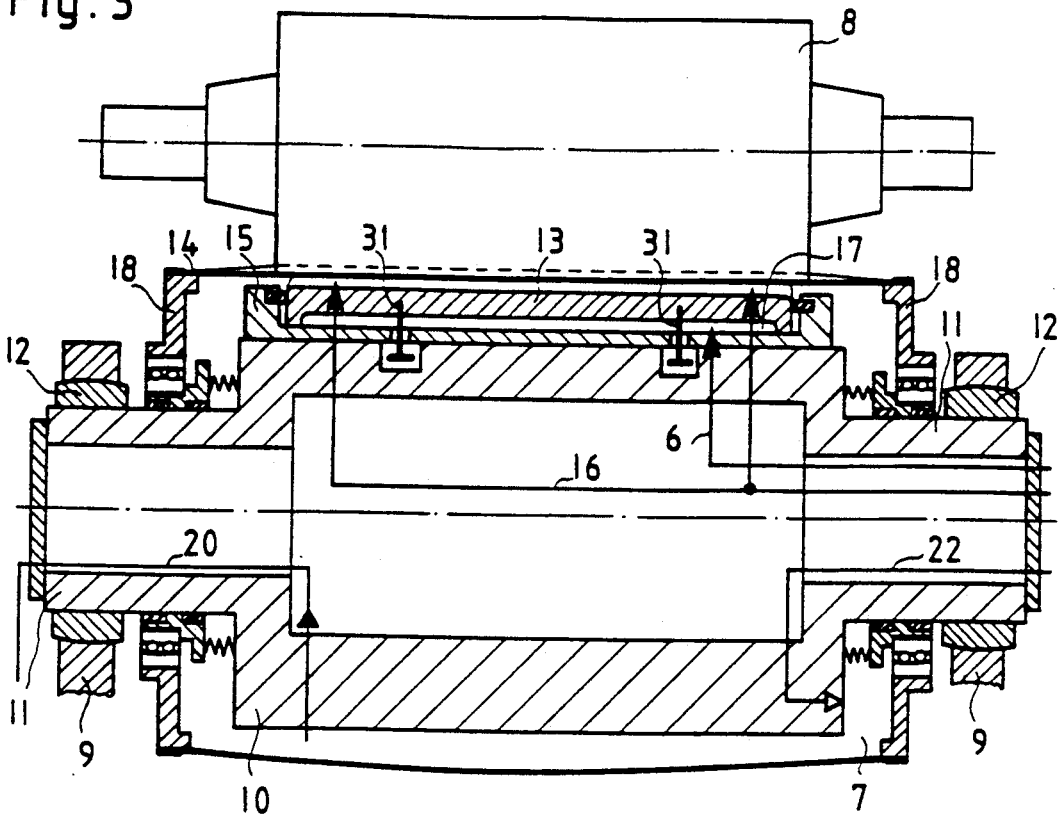
FIG. 3 is a diagrammatic longitudinal sectional view, showing a variation of the extended nip press cross-section taken along the line III of FIG. 1.

As shown in FIG. 3, the stationary support member 10 has two oppositely directed, hollow, journal pins 11. Each pin has a sleeve 12 by which it rests in a respective bearing pedestal 9, and this absorbs sagging of the member 10. The axial ends of the press jacket 14 are fastened to jacket support disks 18 which are rotatably mounted on the journal pins 11.

FIG. 3 schematically shows a feed line 16 and a suction line 20 for respectively supplying and removing lubricating oil between the shoe surface and the press jacket and a feed line 22 for supplying compressed air for producing pressure in the sealed off interior 7 of the press jacket.

The shoe bed 15 and the press shoe 13 together form a cylinder-piston unit. For this purpose, the shoe bed 15 has a rectangular depression, as seen from above, which opens toward the press jacket and which receives the rectangular press shoe 13. The peripheral shape of the press shoe generally corresponds to that of the depression. The depression is closed on its bottom. Furthermore, sealing strips 23, 24 surround the press shoe 13 on all lateral sides and without interruption. These strips are arranged in the shoe bed 15 around the peripheral side wall of the depression. Thus, the depression 17 forms a pressure chamber which can be acted on by pressure fluid via a pressure conduit 6. This causes the press shoe 13 to press the press jacket 14 against the backing roll 8, which roll is omitted in FIG. 2. The press jacket 14 and the backing roll 8 together form an extended press nip. A fiber web to be dewatered and at least one dewatering felt belt, called a felt, pass through the extended press nip. Both the web and the felt have been omitted from the drawings. The shoe bed 15 is detachably connected by screws 26 to the press support 10.

Figure 2:
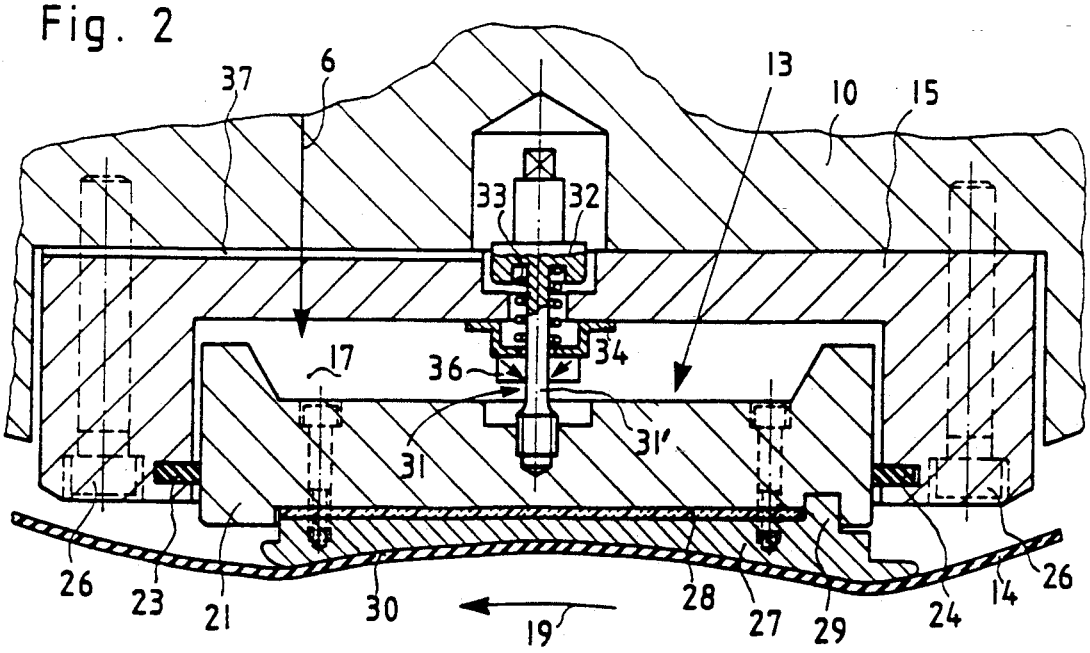
FIG. 2 is a partial cross section through a press with the opposite direction of applied pressure on the press shoe.

As shown in FIGS. 1 and 2, the press shoe is divided into a piston 21 toward the bottom of the depression, a slide ledge 27 fastened to the piston facing out of the depression, and a heat insulating plate 28 between them. In relatively narrow cross machine width paper manufacturing machines, the press shoe 13, however, can also be made in one piece as shown in FIG. 3. The piston 21 and the slide ledge 27 are connected in form-locked manner to each other by a longitudinal rib 29.

At least one opening 25 is formed in the bottom of the shoe bed 15. A connecting element 31 extends through the pressure chamber 17 and is screwed into the press shoe 13 and also extends through the opening 25 in the bottom of the depression and the shoe bed. The connecting element extends out of the side of the press shoe opposite the top slide surface. On the other end of the opening 25 and outside the chamber 17, the connecting element 31 has a head 32 which, together with the outer surface of the bottom of the shoe bed 15, forms a pair of cooperating, opposed, abuttable stop surfaces 5. The stroke of the press shoe 13 out of the depression is limited by the pair of stop surfaces, particularly when the structural unit comprised of the shoe bed 15 and the press shoe 13 is tested for tightness outside of the paper manufacturing machine. However, this limitation upon the stroke of the press shoe by the connecting element 31 is also of advantage when assembled with the paper manufacturing machine, for instance, in the event that the backing roll 8 is removed during a standstill. This is particularly true if the backing roll is in the lower or bottom position, as shown in FIG. 2, because with the backing roll absent, the shoe could fall out. A spring 33 at the connecting element counteracts the pressure prevailing in the pressure chamber 17 and urges the connecting element to move back into the support 10. In the arrangement shown in FIG. 2, the spring force acts at the same time against the force of gravity which is acting on the press shoe 13. If the pressure chamber 17 is not pressurized, the press shoe 13 is then pulled back upward by the spring force. The spring 33 is preferably developed as a compression spring which rests, for instance, via a flange 34 on the bottom of the shoe bed 15. Differing from FIGS. 1 and 2, the spring 33 can be replaced by a small hydraulic cylinder.

In order that no pressure fluid might escape through the opening 25 in the shoe bed 15, the opening is closed in a pressure tight manner, as shown in FIG. 1, by a pot 35 which surrounds the head 32 of the connecting element 31. Another possibility is indicated in FIG. 2. A flexible packing ring 36 rests against the connecting element 31 and is arranged on the flange 34. Since a 100% seal is not to be expected by this arrangement, the opening 25 for the connecting element in the shoe bed 15 is connected, via a relief a groove 37 (shown for example in FIG. 2), with a region of low pressure, for instance, to the interior 7, in FIG. 3, so that leakage oil can flow off to that place.

Figure 4:
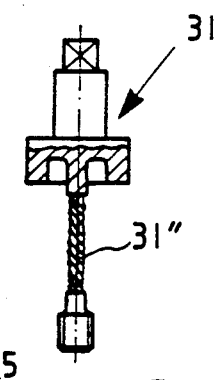
FIG. 4 is a detail of an alternate connecting element for the press shoe.

As indicated in FIGS. 1 and 2, the connecting element 31 can be developed as a flexible bar, for instance. Such a connecting element 31 has a central part or shank 31' of reduced diameter, causing the central part to be flexible. As shown in FIG. 4, the central flexible part can alternately be developed as a rope 31'', for instance, a steel rope. It is also possible for the connecting element to be developed as a joint bolt, preferably with ball joints which assures the possibility of its yielding in all desired directions. In any case, the connecting element is designed to assure that the press shoe 13 can be inclined in any desired direction relative to the shoe bed 15, both in the cross machine direction and in the longitudinal or machine direction, and that the shoe can furthermore expand as normally occurs under the influence of heat.

Figure 5:
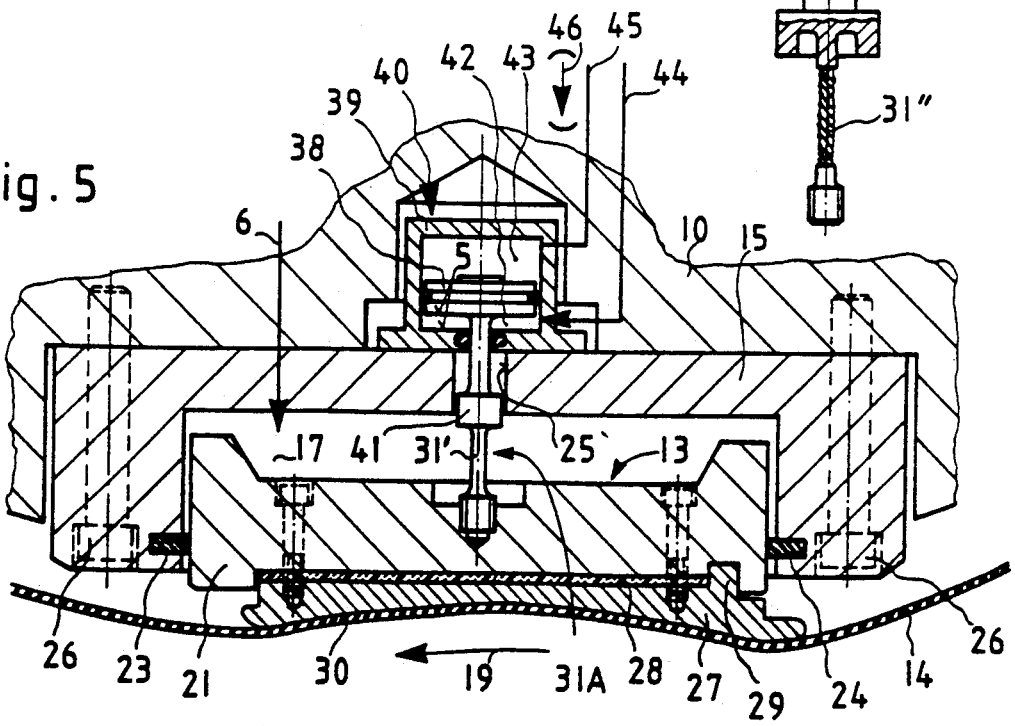
FIG. 5 shows an alternate embodiment of the press of FIG. 2.

The embodiment of FIG. 5 differs from that of FIG. 2. Instead of including a head 32, the connecting element 31A includes an auxiliary piston 38 which is part of an additional cylinder-piston unit 40. The cylinder 39 of the unit 40 is fastened to the outside of the shoe bed 15. Thus, the auxiliary piston 38 and the cylinder 39 form the above mentioned pair of stop surfaces 5 which limits the downward stroke of the press shoe 13. The connecting element 31A again has a flexible shank 31', which is of relatively small diameter. Furthermore, a guide piston 41 can be provided which slides in a bore hole 25 in the shoe bed 15. The pressure space 42 of the cylinder 39, which space is present on the shoe-bed side of the auxiliary piston 38, can be acted on by pressure fluid via a line 44 in order to pull the press shoe 13 back, i.e. upward in FIG. 5. This pull back takes place after relief of the pressure chamber 17 and acts faster than would pull back by the spring 33 of FIG. 2.

There is another possible use of the additional cylinder-piston unit 40. During normal operation, and as long therefore as pressure is present in the pressure chamber 17, the auxiliary piston 38 can exert a controllable local force on the press shoe 13, i.e. a force which counteracts the pressure in the pressure chamber 17. This would enable a reduction in the pressing forces for instance, on the two ends of the press shoe 13 (see FIG. 3).

The other pressure space 43 of the cylinder 39 is, in general, connected with the outside via a vent line 45. However, it is also possible, as indicated by arrow 46, to have pressure fluid act via the line 45 on the pressure space 43. In that case, the pressure space 42 is relieved. This arrangement enables exertion of a controllable local additional force on the press shoe 13, which force acts in the same direction as the pressure in the pressure chamber 17.

As indicated in FIG. 3, several connecting elements 31 or 31A can be arranged distributed over the cross machine length of the press shoe 13. Furthermore, it may be advisable to arrange two connecting elements 31 or 31A alongside of each other in the machine direction, instead of the single connecting element 31 or 31A shown in cross section in FIGS. 1, 2 or 5.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable toward the backing roll for pressing the press element toward the backing roll;

a stationary shoe bed, including a depression opening to the press element, the depression having and being defined by a periphery and a bottom, the press show having a shape generally corresponding to the periphery of the depression and being received in the depression and being displaceable with respect to the depression and the shoe bed;

further comprising a stationary support for supporting the shoe bed stationary with respect to rotation of the backing roll and with respect to displacement of the press shoe, and means detachably connecting the shoe bed to the support;

means in the shoe bed defining a pressure chamber in the depression beneath the press show, whereby the shoe bed and the press shoe together form a cylinder-piston unit with the press show being displaceable with respect to the shoe bed;

at least one connecting element disposed between the shoe bed, and the side of the press shoe opposite the side with the slide surface thereon, for coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction.

2. The extended nip press of claim 1, wherein the connecting element includes means for urging the press shoe to be displaced with respect to the shoe bed and the backing roll.

3. The extended nip press of claim I, wherein the connecting element includes means for normally biasing the press shoe into the depression.

4. The extended nip press of claim 1, wherein the press element is a flexible endless jacket which endlessly passes over the slide surface of the press shoe.

5. The extended nip press of claim 1, wherein the means defining the pressure chamber in the depression comprises a packing for the depression at the periphery of the depression and extending into contact with the press shoe while permitting the press shoe to be displaced and tilted with respect to the shoe bed.

6. The extended nip press of claim 1, wherein the shoe bed has an opening therein at the connecting element, and the connecting element extends from the press shoe, through the pressure chamber and into the opening in the shoe bed.

7. The extended nip press of claim 6, wherein the opening through the shoe bed terminates on a side of the shoe bed which is outside the pressure chamber, and the connecting element having a -head thereon with a respective first stop surface such that displacement of the press shoe displaces the connecting element for moving the first stop surface against the side of the shoe bed, and the side of the shoe bed defines a second stop surface for cooperating with the first stop surface to limit the movement of the connecting element relative to the shoe bed.

8. The extended nip press of claim 7, further comprising means for sealing the opening through the shoe bed in pressure tight manner with the connecting element passing through the opening.

9. The extended nip press of claim 8, wherein sealing means comprises a flexible sealing ring which rests against the connecting element and the press bed.

10. The extended nip press of claim 1, wherein the connecting element extends from the press shoe, through the pressure chamber in the depression, and into the bottom of the depression of the shoe bed, and the connecting element being held in the shoe bed in a manner permitting displacement of the press shoe with respect to the shoe bed.

11. The extended nip press of claim 10, wherein the flexible part of the connecting element comprises a flexible bar.

12. The extended nip press of claim 6, further comprising biasing means at the connecting element having a spring force which is directed to counteract the pressure prevailing in the pressure chamber, the biasing means acting on the connecting element for moving the connecting element to urge the press shoe against the pressure prevailing in the pressure chamber.

13. The extended nip press of claim 1, further comprising a cylinder-piston unit connected with the connecting element, wherein the connecting element comprises the piston of the cylinder-piston unit, and the cylinder being connected to cause the pressure in the cylinder to exert a pressure on the connecting element which counteracts the pressure in the pressure chamber that is acting on the press shoe.

14. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable toward the backing roll for pressing the press element toward the backing roll;

a stationary shoe bed, including a depression opening to the press element, the depression having and being defined by a periphery and a bottom, the press shoe having a shape generally corresponding to the periphery of the depression and being received in the depression and being displaceable with respect to the depression and the shoe bed;

means in the shoe bed defining a pressure chamber in the depression beneath the press shoe, whereby the shoe bed and the press shoe together form a cylinder-piston unit with the press shoe being displaceable with respect to the shoe bed;

at least one connecting element extending between and coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction;

wherein the shoe bed has an opening therein at the connecting element, and the connecting element extends from the press shoe, at the side of the press shoe opposite the side with the slide surface thereon, through the pressure chamber and into an opening in the shoe bed;

wherein the opening through the shoe bed terminates on a side of the shoe bed which is outside the pressure chamber, and the connecting element has a head thereon with a respective first stop surface such that displacement of the press shoe displaces the connecting element for moving the first stop surface against the side of the shoe bed, and the side of the shoe bed defines a second stop surface for cooperating with the first stop surface to limit the movement of the connecting element relative to the shoe bed; and further comprising means normally biasing the connecting element for moving the first and second stop surfaces apart and for normally biasing the press shoe into the depression, at least in the vicinity of the connecting element.

15. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable towrd the backing roll for pressing the press element toward the backing roll;

a stationary shoe bed, including a depression opening to the press element, the depression having and being defined by a periphery and a bottom, the press shoe having a shape generally corresponding to the periphery of the depression and being received in the depression and being displaceable with respect to the depression and the shoe bed;

means in the shoe bed defining a pressure chamber in the depression beneath the press shoe, whereby the shoe bed and the press shoe together form a cylinder-piston unit with the press shoe being displaceable with respect to the shoe bed;

at least one connecting element extending between and coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction;

wherein the shoe bed has an opening therein at the connecting element, and the connecting element extends from the press shoe, at the side of the press shoe opposite the side with the slide surface thereon, through the pressure chamber and into an opening in the shoe bed;

wherein the opening through the shoe bed terminates on a side of the shoe bed which is outside the pressure chamber, and the connecting element has a head thereon with a respective first stop surface such that displacement of the press shoe displaces the connecting element for moving the first stop surface against the side of the shoe bed, and the side of the shoe bed defines a second stop surface for cooperating with the first stop surface to limit the movement of the connecting element relative to the shoe bed; and further comprising means for sealing the opening through the shoe bed in pressure tight manner with the connecting element passing through the opening; and wherein the means for sealing the opening in the shoe bed comprises a pot surrounding the head of the connecting element, and the pot being sealed to the shoe bed.

16. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable toward the backing roll for pressing the press element toward the backing roll;

a stationary shoe bed, including a depression opening to the press element, the depression having and being defined by a periphery and a bottom, the press shoe having a shape generally corresponding to the periphery of the depression and being received in the depression and being displaceable with respect to the depression and the shoe bed;

means in the shoe bed defining a pressure chamber in the depression beneath the press shoe, whereby the shoe bed and the press shoe together form a cylinder-piston unit with the press shoe being displaceable with respect to the shoe bed;

at least one connecting element extending between and coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction;

wherein the shoe bed has an opening therein at the connecting element, and the connecting element extends from the press shoe, at the side of the press shoe opposite the side with the slide surface thereon, through the pressure chamber and into an opening in the shoe bed;

wherein the opening through the shoe bed terminates on a side of the shoe bed which is outside the pressure chamber, and the connecting element has a head thereon with a respective first stop surface such that displacement of the press shoe displaces the connecting element for moving the first stop surface against the side of the shoe bed, and the side of the shoe bed defines a second stop surface for cooperating with the first stop surface to limit the movement of the connecting element relative to the shoe bed;

further comprising means for sealing the opening through the side bed in pressure tight manner with the connecting element passing through the opening;

wherein the sealing means comprises a flexible sealing ring which rests against the connecting element and the press bed; and further comprising a low pressure region at the shoe bed and a relief groove communicating between the opening and the low pressure region.

17. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable toward the backing roll for pressing the press element toward the backing roll;

a stationary shoe bed, including a depression opening to the press element, the depression having and being defined by a periphery and a bottom, the press shoe having a shape generally corresponding to the periphery of the depression and being received in the depression and being displaceable with respect to the depression and the shoe bed;

means in the shoe bed defining a pressure chamber in the depression beneath the press shoe, whereby the shoe bed and the press shoe together form a cylinder-piston unit with the press shoe being displaceable with respect to the shoe bed;

at least one connecting element extending between and coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction;

wherein the flexible part of the connecting element is in the form of a rope.

18. An extended nip press for dewatering a fiber web, the press comprising:

a rotatable backing roll;

a press shoe having a concave slide surface generally adapted to the shape of and opposable to the periphery of the backing roll;

an endless flexible press element between the press shoe slide surface and the backing roll, and the press shoe being displaceable toward the backing roll for pressing the press element toward the backing roll;

a stationary shoe bed, including a depression opening to the press element, the depression having and being defined by a periphery and a bottom, the press shoe having a shape generally corresponding to the periphery of the depression and being received in the depression and being displaceable with respect to the depression and the shoe bed;

means in the shoe bed defining a pressure chamber in the depression beneath the press shoe, whereby the shoe bed and the press shoe together form a cylinder-piston unit with the press shoe being displaceable with respect to the shoe bed;

at least one connecting element extending between and coupling the press shoe to the shoe bed, the connecting element comprising a flexible part structured to permit both displacement of the press shoe toward and away from the backing roll and tilting of the press show in any desired direction relative to the shoe bed in both the machine direction and the cross-machine direction, further comprising an auxiliary cylinder-piston unit connected with the connecting element, wherein the connecting element comprises the piston of the auxiliary cylinder-piston unit, and the cylinder being connected to cause the pressure in the cylinder to exert a pressure on the connecting element which counteracts the pressure in the pressure chamber that is acting on the press shoe;

wherein the cylinder of the auxiliary cylinder-piston unit is fastened on the shoe bed; the cylinder defining the first of a pair of stop surfaces and the piston defining the second of the pair of stop surfaces, which surfaces are brought together by displacement of the press shoe out of the depression to limit the stroke of the press shoe out of the depression.

19. The extended nip press of claim 18, wherein the auxiliary cylinder-piston unit is double acting, with the piston being so placed in the cylinder of the auxiliary cylinder-piston unit that the piston and the attached connecting element may be selectively acted upon to counteract the pressure prevailing in the pressure chamber and to selectively act on the pressure shoe in the same direction as the pressure prevailing in the pressure chamber.

20. A press shoe and shoe bed combination for use in an extended nip press, the combination comprising:

a press shoe having a concave slide surface generally adapted to the shape of the periphery of a backing roll, the press shoe being displaceable toward the backing roll for the slide surface to press a press element toward the backing roll;

a stationary shoe bed including an open depression, the depression having and being defined by a periphery and a bottom, the press shoe having a shape generally corresponding to the periphery of the depression and being received in the depression and being displaceable with respect to the depression and the shoe bed;

further comprising a stationary support for supporting the shoe bed stationary with respect to rotation of the backing roll and with respect to displacement of the press shoe, and means detachably connecting the shoe bed to the support;

means in the shoe bed defining a pressure chamber in the depression beneath the press shoe, whereby the shoe bed and the press shoe together form a cylinder-piston unit with the press shoe being displaceable with respect to the shoe bed;

at least one connecting element disposed between the shoe bed, and the side of the press shoe opposite the side with the slide surface thereon, for coupling the press shoe to the shoe bed, the connecting element comprising a flexible part structured to permit both displacement of the press shoe toward and away from the backing roll and tilting of the press shoe in any desired direction relative to the shoe bed in both the machine direction and the cross-machine direction, the connecting element extending from the press shoe, through the pressure chamber in the depression, and into the bottom of the depression of the shoe bed, and the connecting element being held in the shoe bed in a manner permitting displacement of the press shoe with respect to the shoe bed.

21. The combination of claim 20, wherein the means defining the pressure chamber in the depression comprises a packing for the depression at the periphery of the depression and extending into contact with the press shoe while permitting the press shoe to be displaced and tilted with respect to the shoe bed.

22. The combination of claim 20, wherein the shoe bed has an opening therein at the connecting element, and the connecting element extends from the press shoe, through the pressure chamber and into the opening in the shoe bed.

23. The combination of claim 22, wherein the opening through the shoe bed terminates on a side of the shoe bed which is outside the pressure chamber, and the connecting element having a head thereon with a respective first stop surface such that displacement of the press shoe displaces the connecting element for moving the first stop surface against the side of the shoe bed, and the side of the shoe bed defines a second stop surface for cooperating with the first stop surface to limit the movement of the connecting element relative to the shoe bed.

24. The combination of claim 23, further comprising means normally biasing the connecting element for moving the first and second stop surfaces apart and for normally biasing the press shoe into the depression, at least in the vicinity of the connecting element.

25. The combination of claim 23, further comprising means for sealing the opening through the shoe bed in pressure tight manner with the connecting element passing through the opening; wherein the means for sealing the opening in the shoe bed comprises a pot surrounding the head of the connecting element, and the pot being sealed to the shoe bed.

26. The combination of claim 23, further comprising means for sealing the opening through the shoe bed in pressure tight manner with the connecting element passing through the opening; wherein the sealing means comprises a flexible sealing ring which rests against the connecting element and the press bed; and further comprising a low pressure region at the shoe bed and a relief groove communicating between the opening and the low pressure region.

27. The combination of claim 20, wherein the flexible part of the connecting element is in the form of a rope.

28. The combination of claim 20, further comprising an auxiliary cylinder-piston unit connected with the connecting element, wherein the connecting element comprises the piston of the auxiliary cylinder-piston unit, and the cylinder being connected to cause the pressure in the cylinder to exert a pressure on the connecting element which counteracts the pressure in the pressure chamber that is acting on the press shoe;

wherein the cylinder of the auxiliary cylinder-piston unit is fastened on the shoe bed; the cylinder defining the first of a pair of stop surfaces and the piston defining the second of the pair of stop surfaces which surfaces are brought together by displacement of the press shoe out of the depression to limit the stroke of the press shoe out of the depression.

29. The combination of claim 28, wherein the auxiliary cylinder-piston unit is double acting, with the piston being so placed in the cylinder of the auxiliary cylinder-piston unit that the piston and the attached connecting element may be selectively acted upon to counteract the pressure prevailing in the pressure chamber and to selectively act on the pressure shoe in the same direction as the pressure prevailing in the pressure chamber.

* * * * *